United States Patent [19]

Schmitt

[11] Patent Number: 5,054,273

[45] Date of Patent: Oct. 8, 1991

[54] SYSTEM FOR INFLATING BALLOONS AND INSERTING OBJECTS THEREINTO

[75] Inventor: George E. Schmitt, Brandon, Fla.

[73] Assignee: Maxim Marketing, Salt Lake City, Utah

[21] Appl. No.: 474,365

[22] Filed: Feb. 2, 1990

[51] Int. Cl.[5] ..... B65B 43/36; B65B 39/02; B65B 39/06; B65B 31/00

[52] U.S. Cl. ..... 53/564; 53/567; 53/577; 53/258; 53/385.1; 53/79; 53/390

[58] Field of Search ..... 53/434, 459, 258, 385, 53/390, 457, 570, 567, 260, 262, 433, 403, 473, 79, 88, 564, 577; 137/268, 223, 1, 584; 446/220, 222, 223, 226

[56] References Cited

U.S. PATENT DOCUMENTS

| | | | |
|---|---|---|---|
| 3,474,836 | 10/1969 | Schwake et al. | 53/385 X |
| 4,183,194 | 1/1980 | Lucke | 53/385 X |
| 4,809,483 | 3/1989 | Lovik | 53/385 X |
| 4,809,484 | 3/1989 | Lovik | 53/385 X |
| 4,811,841 | 3/1989 | Domenichiello | 53/390 X |
| 4,878,335 | 11/1989 | Hardy | 53/385 X |
| 4,974,393 | 12/1990 | Rich et al. | 53/386 X |

*Primary Examiner*—Horace M. Culver
*Attorney, Agent, or Firm*—Thorpe, North & Western

[57] ABSTRACT

Apparatus for inflating balloons to enable inserting objects thereinto include a housing having a lower compartment and an upper compartment, a first elongate tubular element disposed in the upper compartment to extend upwardly from the lower compartment where the upper end of the tubular element includes one or more openings, and a second elongate tubular element telescopically disposed in the upper compartment about the first tubular element to slide longitudinally relative thereto between an upper position, in which an object may be inserted into the second tubular element to rest against the upper end of the first tubular element, and a lower position, in which the upper ends of the first and second tubular elements are generally at the same elevation. The upper end of the second tubular element is open and is adapted to receive and releasably hold a balloon orifice thereover. A pump is disposed in the lower compartment of the housing for pumping air under pressure into the first tubular element, out the upper end opening thereof, and into the second tubular element to inflate a balloon whose orifice is positioned over the upper end of the second tubular element.

11 Claims, 2 Drawing Sheets

SYSTEM FOR INFLATING BALLOONS AND INSERTING OBJECTS THEREINTO

BACKGROUND OF THE INVENTION

This invention relates to apparatus and method for inflating balloons and, while inflated, for allowing insertion thereinto of objects for display, gifts, etc.

It has become popular in recent times to package gifts or display items in an inflated balloon for giving or presentation. In order to place the gift item inside the balloon, it is necessary to both inflate the balloon and expand the orifice or mouth thereof. This is done generally by using some type of device to expand the balloon mouth and inflate the balloon so as to leave the operator's hands free to then insert the gift item. Examples of devices and apparatus which have been developed for automatically inflating a balloon are described in U.S. Pat. Nos. 4,809,484, 4,811,841 and 4,878,335, and in co-pending U.S. patent application, Ser. No. 326,612.

In both U.S. Pat. Nos. 4,809,484 and 4,811,841, above cited, there are disclosed balloon inflating machines which include a tubular member having a closed end and an open end about which a balloon mouth may be placed. A movable plunger is disposed in the tube and is elevatable or lowerable within the tube in a type of telescopic action. The top of the plunger includes a platform or other holding device on which a gift item or object may be placed. When the balloon is inflated and the gift item is disposed in the tubular member on the platform, the plunger may be actuated to move upwardly and force the gift item into the inflated balloon. Although this approach is relatively simple and effective, the apparatus can be cumbersome in that the operation of the plunger to move upwardly and force the gift item into the inflated balloon must either be automatic, as in U.S. Pat. No. 4,811,841, or a fairly cumbersome pouch or bag must be provided for wrapping about the lower end of the plunger to prevent the escape of air from the balloon.

SUMMARY OF THE INVENTION

It is an object of the invention to provide a simple, easy to use and relatively inexpensive system for inflating balloons and allowing the insertion thereinto of objects, gifts, prizes, etc.

It is also an object of the invention to provide such a system for accommodating more than one size of object or gift and accordingly more than one size of balloon and balloon mouth.

It is a further object of the invention to provide such a system which may be easily operated by hand to inflate a balloon and place an object thereinto.

It is an additional object of the invention to provide such a system which may easily handled and lifted for disposition on the floor, a table, or other support structure.

The above and other objects of the invention are realized in a specific illustrative embodiment of balloon inflating apparatus which includes a first elongate tubular member disposed generally in a vertical position and including a platform at the upper end thereof for supporting an object, said platform having one or more openings therein through which gas may pass. A second elongate tubular member is disposed about the first tubular member to slide longitudinally with respect to the first member, the upper end of the second tubular member including a retaining element for receiving and releasably retaining the mouth of a balloon. The apparatus also includes a sealing element disposed between the first and second tubular members to prevent the flow of gas therepast. A pump is provided for pumping gas or air into the first tubular member to then flow through the openings in the platform and into the second tubular member to inflate a balloon whose mouth has been placed over the upper end of the second member about the retaining element.

The above described apparatus is used to inflate a balloon and to allow insertion thereinto of an object by first pulling the second tubular member upwardly and then inserting an object into the second tubular member to rest on the platform of the first tubular member. The mouth of a balloon is then stretched about the retaining element located at the upper end of the second tubular member so that the interior of the balloon communicates only with the interior of the second tubular member. The pump is then operated to direct air into the first tubular member, out the openings in the platform of the first tubular member, into the second tubular member, and finally into the balloon disposed on the second tubular member to thereby inflate the balloon. When the balloon has reached the desired size, the pump is turned off and the second tubular member is then pushed downwardly so that in effect the balloon on top of the second tubular member is pushed downwardly about the object resting on the platform at the top of the first tubular member. With the object now disposed inside the inflated balloon, the mouth of the balloon is carefully urged off the retaining element at the top of the second tubular member and tied or otherwise closed to prevent the escape of air. The object, of course, is still inside the inflated balloon and the desired packaging is achieved.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
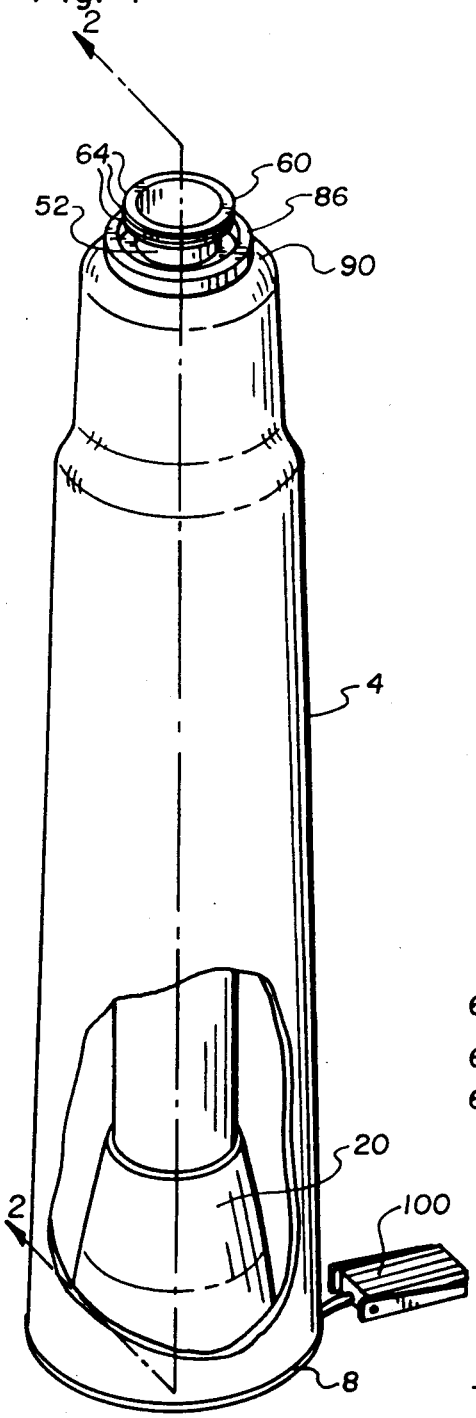
FIG. 1 is a perspective, partially cut-away view of a system for inflating balloons made in accordance with the principles of the present invention.

Referring to the drawings there is shown a specific embodiment of apparatus capable of carrying out the objects of the invention. This apparatus includes an elongate, generally tubular housing 4 having a base support plate 8 formed to define a small cavity or hollow 12 under the housing when it rests upon a platform 16. The housing 4 and plate 8 might illustratively be made of polycarbonate or other similar lightweight and yet sturdy material.

Disposed at the bottom of the housing 4 on the support plate 8 is an enclosure 20 which defines a compartment 22 for housing an air pump, such as a centrifical blower 24, to produce positive air pressure in the compartment for purposes to be described momentarily. Openings 28 are formed in the support plate 8 to allow air to be drawn therethrough into the compartment 22 by the air pump 24, which air will then be forced upwardly through a sleeve 32 disposed in the top wall of the enclosure 20.

Figure 2:
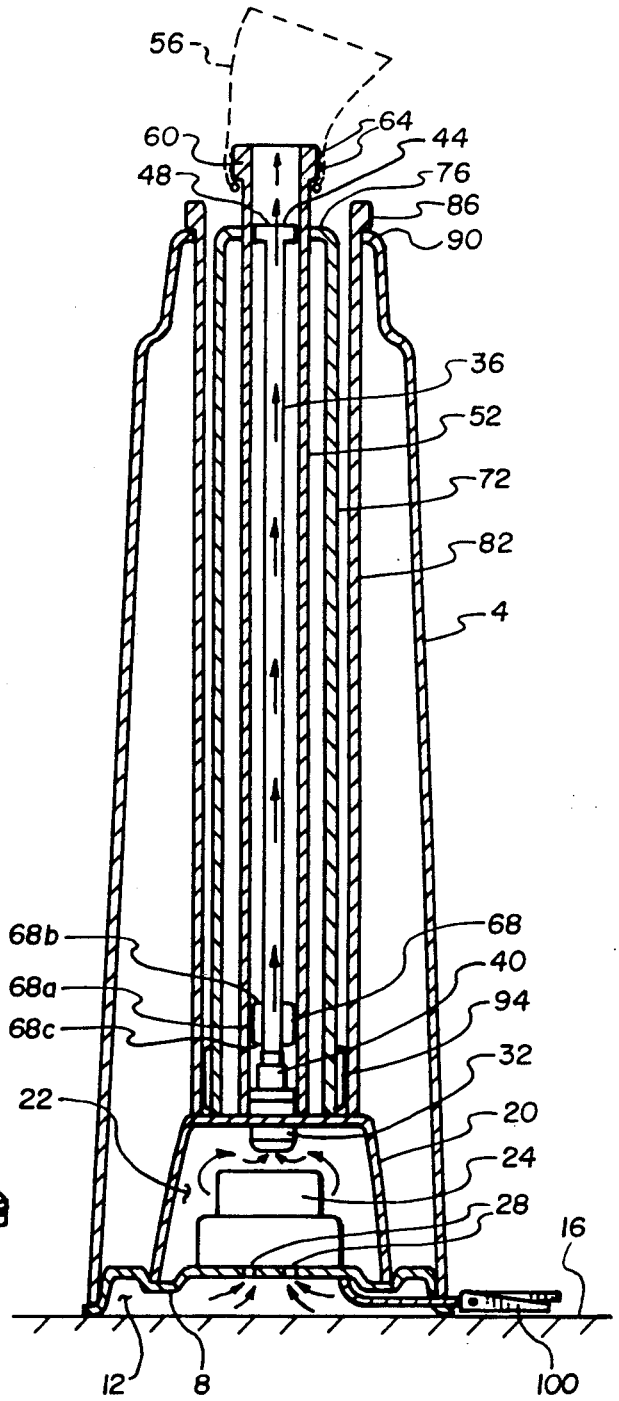
FIG. 2 is a side, cross-sectional elevational view of the system of FIG. 1 taken along lines 2—2.

A plurality of tubular members are telescopically positioned on top of the enclosure 20, as shown in FIG. 2, to define an upper compartment area. A first fixed tubular member 36 is disposed centrally on top of the enclosure 20 to extend therefrom generally vertically upwardly to the top of the housing 4. A oneway check valve 40 connects the bottom of the tubular member 36 to the sleeve 32 to thereby gaseously connect the interior of the tubular member 36 to the compartment 22. A platform 44 is formed at the top of the tubular member 36 to provide support for an object or gift which is to be deployed inside an inflated balloon as will be described in further detail later. One or more openings 48 are formed in the platform 44 to allow air forced upwardly inside the tubular member 36 to escape into the interior of a telescopically slidable tubular member 52.

Figure 3:
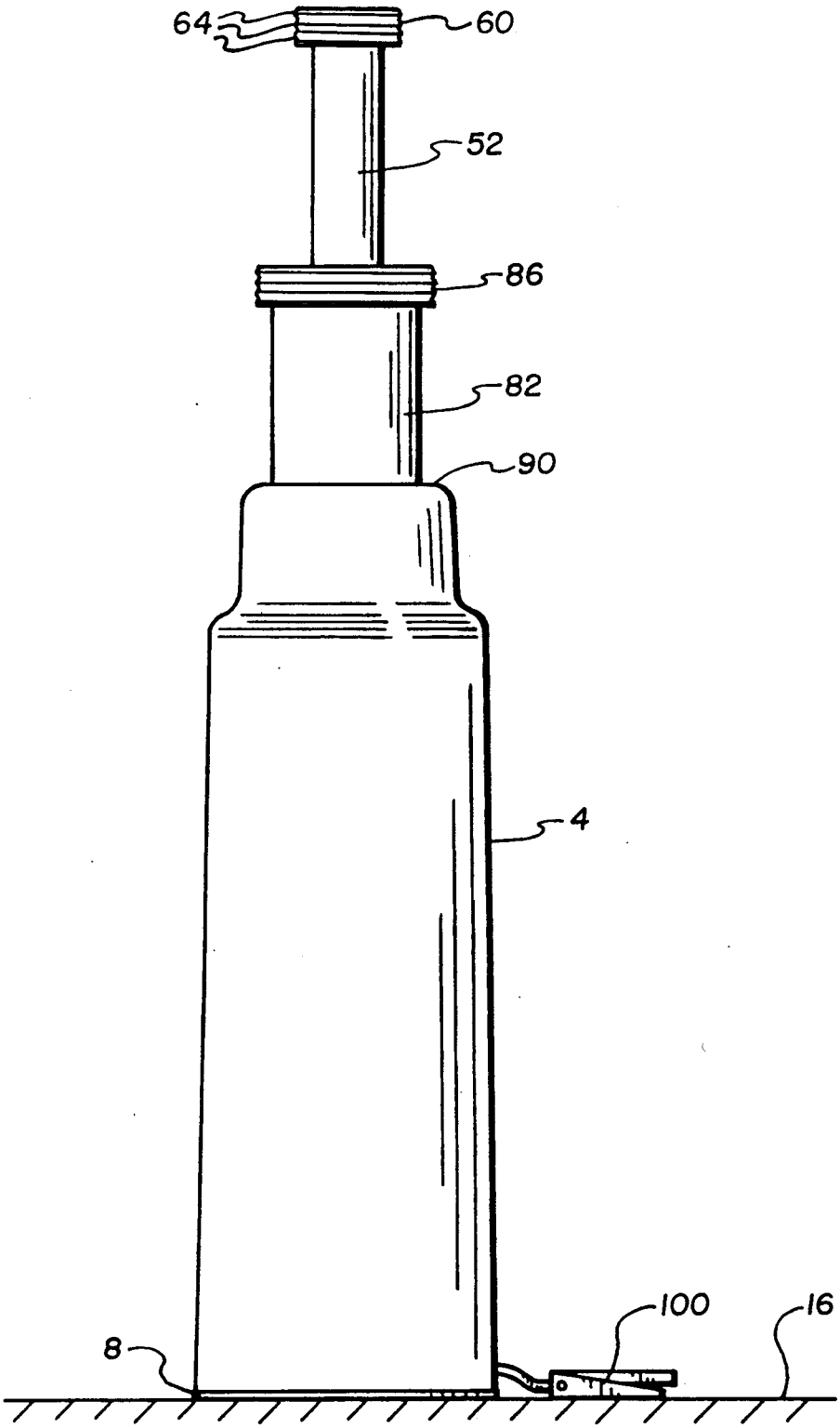
FIG. 3 is a side, elevational view of the system of FIG. 1 showing the slideable tubular members at least partially raised from their rest positions.

The tubular member 52 is slidably disposed about tubular member 36 to move longitudinally between a lower position, in which the tubular member 52 rests on the top of enclosure 22 and its upper end is near but slightly above the platform 44, and an upper position, in which the upper end of the tubular member 52 is elevated some distance above the platform 44 and the low end of the tubular member 52 is just below the platform (see FIG. 3). The perimeter of the platform 44 is in frictional contact with the interior surface of the tubular member 52 to inhibit sliding of the tubular member and thereby maintain the tubular member in the upper position. In the upper position, objects or gifts which are to be inserted inside of inflated balloons may be placed in the tubular member 52 to slide down and rest on the platform 44 of the tubular member 36. Also, in this upper position, the mouth of a balloon 56 would be placed over the upper end of the tubular member 52 in preparation for inflating the balloon.

The upper end of the tubular member 52 is formed with a balloon retaining lip 60 which extends outwardly from the tubular member to provide a barrier for maintaining a balloon mouth, for example of balloon 56, about the upper end of the tubular member. A plurality of ridges 64 are circumferentially formed on the lip 60 to further provide resistance to removal or slipping off of the mouth of balloon 56 from the upper end of the tubular member 52.

Disposed on the inside wall of the tubular member 52 at the bottom thereof is a resilient annulus or collar 68 which encircles the tubular member 36. The annulus 68 includes an outer wall **68*a* which is attached to the inner surface of the tubular member 52, and a pair of longitudinally spaced apart flanges 68*b* and 68*c* which extend inwardly from the outer wall 68*a* to contact and wipe over the outer surface of the tubular member 36, and thereby provide a seal to prevent the flow of air or gas therepast. Advantageously, the annulus 68 is made of resilient plastic. The tubular members 36 and 52** may advantageously be made of polycarbonate.

Disposed about the tubular member 52 is a support tubular member 72 which is disposed on the top of enclosure 20 to extend upwardly therefrom. The tubular member 72 completely encircles the tubular member 52 and includes at the upper end thereof an inwardly turned rim or edge 76 which terminates near the outer surface of the tubular member 52 to provide support thereof as the tubular 52 is slid upwardly and downwardly. Again, the tubular member 72 might illustratively be made of polycarbonate.

A second telescopically slidable tubular member 82 is disposed about the support tubular member 72 and is arranged to longitudinally slide from a lower position, where its lower end rests on the enclosure 20, to an upper position, where its upper end extends nearly the length of the tubular member above the top of the housing 4. The upper end of the tubular member 82 also includes an outwardly projecting balloon mouth retaining lip 86 which, when the tubular member 82 is in its lower position, rests on inwardly projecting upper edges 90 of the housing 4. The upper edges 90 of the housing 4 are in frictional contact with the exterior surface of the tubular member 82 to aid in maintaining the tubular member in the upper position after being so placed there.

On the inside wall of the tubular member 82 near the bottom thereof, a sealing annulus or collar 94 is positioned to extend inwardly toward and contact the outer surface of the support tubular member 76 and to wipe thereover as the tubular member 82 is raised and lowered. This provides a seal between the inside of the tubular member 82 and the outside. Annulus 94 and annulus 68 assist in maintaining tubular members 82 and 52 respectively in the upper positions of the tubular members.

The provision of slidable tubular member 82, which is larger in diameter than slidable tubular member 52, allows for accommodating larger objects and gifts for insertion into larger balloons. Here, the mouth of a larger balloon would be disposed over the lip 86 when the tubular member 82 were in the upper or raised position, in preparation for inflating and receiving the object. While in the raised position, and before a balloon is positioned over the upper end thereof, an object would be inserted into the tubular member 82 to drop down and rest upon the top of tubular member 52. A balloon would then be placed over the lip 86 of the tubular member 82 in preparation of inflation of the balloon.

A foot operated switch mechanism 100 is coupled to the air pump 24 to allow for turning the pump on and off by simply depressing the switch mechanism. Other switch mechanisms, either hand and operated, foot operated or otherwise operated, could be provided.

In use, either tubular member 52 or tubular member 82 is selected for use in receiving an object or gift, inflating a balloon, and then inserting the object into the balloon. The selected tubular member is pulled by hand up from the housing 4 by the operator and the object to be inserted into a balloon is then placed inside the selected tubular member to slide downwardly until it rests either on the platform 44 (if tubular member 52 is selected) or upon the top of tubular member 52 (if tubular member 52 is selected). The mouth of the balloon to be used is then stretched about the upper end of the selected tubular member and the switch mechanism 100 is operated to turn on the pump 24. The pump 24 blows air through the valve 40 and up the tubular member 36 into the balloon to inflate the balloon. When the balloon is inflated to the desired size, the selected tubular member is lowered by hand until the inflated balloon is positioned about the object as it rests either on the platform 44 or the upper end of tubular member 52. The mouth of the balloon may then either be rolled off the end of the selected tubular member and tied, or first tied and then rolled off the tubular member to provide the desired balloon packaging of the object.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. Apparatus for inflating balloons and for inserting objects thereinto, comprising a housing having a lower compartment and an upper compartment, a first elongate tubular element disposed in the upper compartment to extend upwardly from the lower compartment, the upper end of said tubular element including one or more openings, a second elongate tubular element telescopically disposed in the upper compartment about the first tubular element to slide longitudinally relative thereto between an upper position, in which an object may be inserted into the second tubular element to rest against the upper end of the first tubular element, and a lower position, in which the upper ends of the first and second tubular elements are generally at the same elevation, the upper end of the second tubular element being open and adapted to receive and releasably hold a balloon orifice thereover, and means disposed in the lower compartment of the housing for directing gas under pressure into the first tubular element, out the upper end opening thereof, and into the second tubular element to inflate a balloon whose orifice is positioned over the upper end of the second tubular element.

2. Apparatus as in claim 1 further including sealing means disposed on the inner surface of the wall of the second tubular element near the lower end thereof for sliding contact with the outer surface of the wall of the first tubular element to provide a substantially gas-tight seal between the first and second tubular elements and prevent the escape of gas from between the elements.

3. Apparatus as in claim 2 wherein said sealing means comprises a resilient annulus.

4. Apparatus as in claim 3 wherein said annulus is formed with an outer annular wall for attachment to said inner surface of the second tubular element, and a pair of spaced-apart flanges which project inwardly from the outer wall to contact the outer surface of the first tubular element.

5. Apparatus as in claim 2 further including check valve means disposed between said gas directing means and the interior of said first tubular element for allowing the passage of gas from the gas directing means to the interior of said first tubular element, and preventing the passage of gas in the opposite direction.

6. Apparatus as in claim 2 wherein said gas directing means comprises a centrifugal blower.

7. Apparatus as in claim 1 further including a third elongate tubular element telescopically disposed in the upper compartment about the second tubular element to slide longitudinally relative thereto between an upper position, in which an object may be inserted into the third tubular element to rest against the upper end of the first or second tubular elements, and a lower position, in which the upper ends of the third and first tubular elements are generally at the same elevation, the upper end of the third tubular element being open and adapted to receive and releasably hold a balloon orifice thereover, wherein the gas directed by the gas directing means flows through the upper end opening of the first tubular element to inflate a balloon whose orifice is positioned over the upper end of the third tubular element.

8. Apparatus as in claim 7 further including an elongate support tubular element disposed int he upper compartment of the housing to extend upwardly from the lower compartment between the second and third tubular elements in fixed relationship to the first tubular element, and second sealing means disposed on the inner surface of the wall of the third tubular element near the lower end thereof for sliding contact with the outer surface of the wall of the support tubular element to provide a substantially gas-tight seal between the third tubular element and the support tubular element.

9. Apparatus as in claim 1 wherein the upper end of the first tubular element includes a flange extending outwardly from the outer surface of the wall of the first tubular element to contact and wipe the wall of the second tubular element as the second tubular element is slid longitudinally relative to the first tubular element.

10. Apparatus as in claim 1 further including a lip formed to extend outwardly from the upper end of the second tubular element.

11. Apparatus as in claim 10 further including a plurality of ridges formed circumferentially on the lip.

* * * * *